United States Patent [19]

Hartman

[11] Patent Number: 4,830,181

[45] Date of Patent: May 16, 1989

[54] WRIST WATCH BOX

[75] Inventor: Herbert N. Hartman, New York, N.Y.

[73] Assignee: E. Gluck Corporation, Long Island City, N.Y.

[21] Appl. No.: 213,714

[22] Filed: Jun. 30, 1988

[51] Int. Cl.[4] ..... B65D 85/40

[52] U.S. Cl. ..... 206/45.19; 206/459; 206/301

[58] Field of Search ..... 206/301, 45.14, 45.19, 206/459

[56] References Cited

U.S. PATENT DOCUMENTS

| | | | |
|---|---|---|---|
| 2,178,652 | 11/1939 | Shields . | |
| 2,330,624 | 9/1943 | Rathbun . | |
| 2,353,522 | 7/1944 | Stern . | |
| 2,412,450 | 12/1946 | Fink . | |
| 2,504,485 | 4/1950 | Allen . | |
| 2,575,016 | 11/1951 | Hopp et al. . | |
| 3,822,781 | 7/1974 | Braginetz . | |
| 4,004,691 | 1/1977 | Wihksne . | |
| 4,005,775 | 2/1977 | Crosslen . | |
| 4,011,942 | 3/1977 | Crosslen . | |
| 4,034,849 | 7/1977 | Zakrajsek . | |
| 4,082,183 | 4/1978 | Sturm | 206/301 |
| 4,199,059 | 4/1980 | Maroszek . | |
| 4,216,858 | 8/1980 | Beauchamp . | |
| 4,457,431 | 7/1984 | Lundquist et al. . | |

OTHER PUBLICATIONS

Photographs (Timex Box) (no date).

*Primary Examiner*—William Price

*Attorney, Agent, or Firm*—Gottlieb, Rackman and Reisman

[57] ABSTRACT

A package for displaying or enclosing an article such as a wrist watch is provided. The package is in the form of a box which includes a base, an article holder slidably and removably positioned in the base and a cover adapted for alternate disposition with respect to the base to provide for both an open display position and an enclosed position. The article holder is removably coupled to the base by means of a tongue which protrudes forwardly from the rear of the base and which engages a shallow groove formed along the top surface of the article holder base member.

32 Claims, 5 Drawing Sheets

WRIST WATCH BOX

BACKGROUND OF THE INVENTION

This invention relates to a wrist watch box for displaying wrist watches to prospective purchasers and for also safely storing them, and more particularly to a wrist watch box which is usable for the alternate display and enclosure of a wrist watch and which is provided with an article holder that may be removably coupled to the base of the box.

Wrist watch packages or boxes constructed to allow the alternate enclosure and display of a wrist watch or the like are known in the art. Such boxes typically include a cover and a base which has essentially the same configuration as the cover, in which the cover is of a slightly larger size so that the base may "nest" within the cover, exposing the access area of the base to establish the display made for the watch box.

Alternatively, the cover and base may be mounted over the base in order to form an essentially fully enclosed package so that the access portion of the base is hidden. This position is desirable for storage and shipping purposes.

Such a wrist watch box assembly further includes a wrist watch holder retained within the base. When the assembly is in the display position, the wrist watch holder may be seen by the observer; when the assembly is in the enclosed position, the watch holder is inaccessible and hidden from view.

Although such wrist watch box assemblies are advantageous, they are still not completely satisfactory in commercial use. In certain prior art configurations, if the wrist watch holder is permanently fixed within the base, it may then be difficult to remove the watch mounted on the holder in order for a sales person to show the watch to a customer. If the wrist watch holder is not fixed to the base, then the watch mounted thereon may easily fall out of or be taken from the interior of the base. This of course creates potential damage or security problems, especially for expensive watches.

Accordingly, it is desirable to provide a wrist watch box assembly which overcomes the above disadvantages, and is also provided with an improved mechanism for removably coupling the watch holder to the base.

SUMMARY OF THE INVENTION

Generally speaking, in accordance with the invention, a package or a box for displaying or enclosing an article such as a wrist watch is provided. The package includes a cover and a base having a front display area. The cover is adapted to receive the base in a display position so that the display area of the base is exposed and is also adapted to fit over the base in an enclosed position so that the display area of the base is concealed.

The assembly also includes a wrist watch holder or collar which may be removably coupled to the interior of the base. In particular, the watch holder includes a ramp which engages a tongue extending forwardly from the inside rear of the base. When the ramp is engaged by the tongue, the watch holder is prevented from slipping out of the interior of the base due to a depending lip on the tongue, which engages a shallow groove formed along the rear of the ramp of the article holder.

Another feature of the invention is that the front portion of the ramp of the article holder defines a surface which is suitable for slidably receiving thereon a card or tag which may be used for advertising, display or pricing purposes.

An optional feature of the invention is a retaining clip formed in part on the collar, which is used in order to hold or lock in place a narrow watch band or other band of unusual configuration on the collar of the watch holder.

Accordingly, it is an object of the invention to provide a wrist watch box in which the cover and the base portions interconnect so that the box may be used for both display and shipping purposes.

Still another object of the invention is to provide a wrist watch box which includes a wrist watch holder that may be removably coupled to the inside of the base.

Still a further object of the invention is to provide a wrist watch box which includes a wrist watch holder having a portion thereof suitable for receiving an advertisement or display card or tag.

Yet another object of the invention is to provide a wrist watch box which includes a retaining clip for preventing a wrist watch for slipping off or around the collar of the watch holder.

Still other objects and advantages of the invention will in part become apparent from the following description.

The invention accordingly comprises an article of manufacture possessing the features, properties and relation of elements which will be exemplified in the article hereinafter described, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENT

Figure 1:
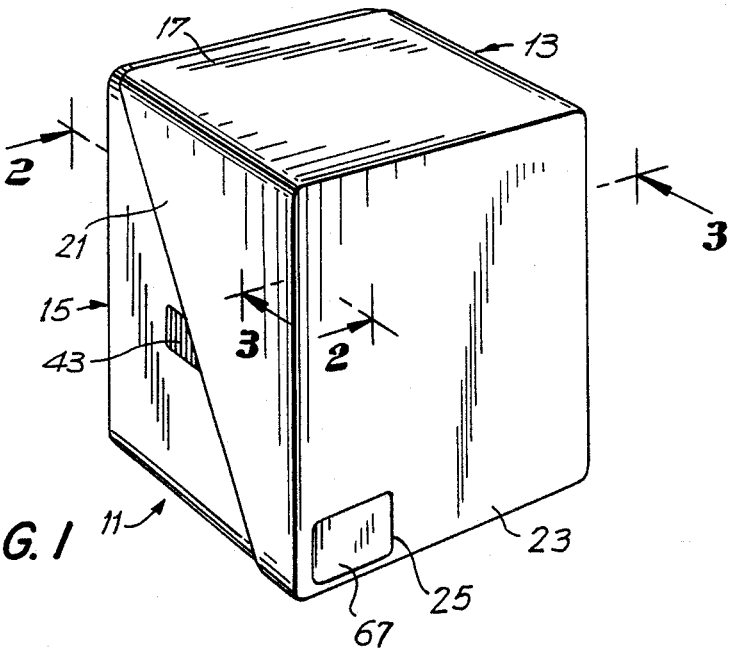
FIG. 1 is a perspective view of the wrist watch box assembly in a fully closed position.
Figures 5, 6:
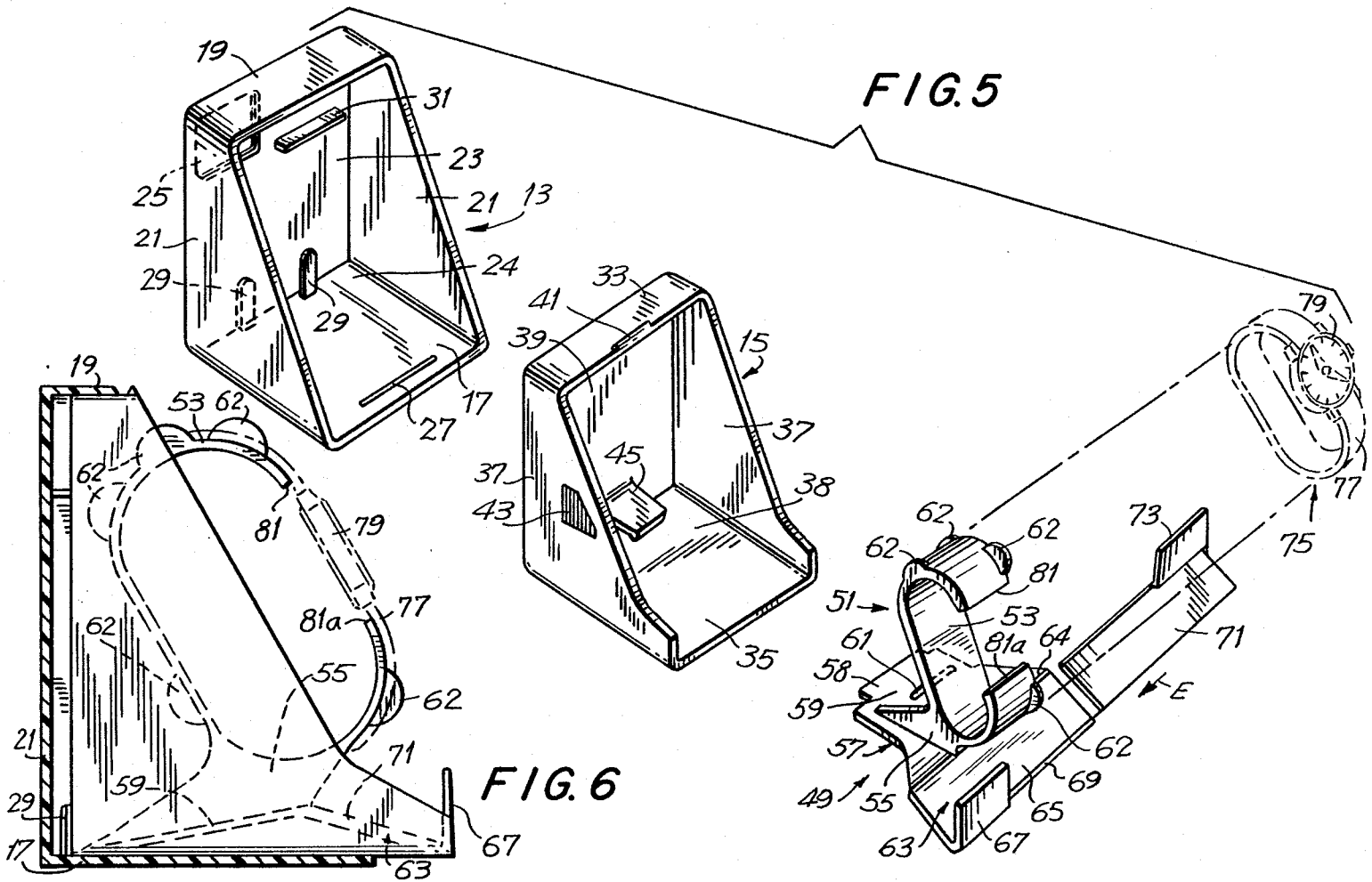
FIG. 5 is an exploded perspective view showing the cover, base and wrist watch holder of the box assembly.
FIG. 6 is a side view in partial cross-section showing the box assembly in a display position.

Referring now to FIGS. 1 and 5, the wrist watch box assembly of the invention generally indicated at 11 consists of a cover 13 and a base 15. Cover 13 is of a hollow box-like configuration and includes opposed side walls 21, a top wall 19, a rear wall 23, and a bottom wall 17. Walls 17, 19, 21 and 23 define a cover interior space 24.

Cover 13 is also provided with a pair of fingers 29 extending up from bottom wall 17 adjacent to rear wall 23 into cover interior space 24, as well as a bar 31 extending from rear wall 23 into cover interior space 24. Fingers 29 and bar 31 are suitable for retaining a small brochure (not shown) therebetween, such as an instruction manual.

Cover 13 further includes a window 25 formed within rear wall 23. Through window 25, as described in more detail below, various trademark or customer information may be displayed.

Optionally, cover 13 may be provided with a groove 27 which is suitable for mating with a detent element of base 15 when box assembly 11 is in the enclosed position of FIG. 1, as detailed below.

Base 15 has essentially the same configuration as cover 13, but with slightly smaller dimensions so that base 15 may nest within cover 13, as shown in FIG. 6. Base 15 includes a top wall 33, a bottom wall 35, opposed side walls 37 and a rear wall 39. Walls 33, 35, 37 and 39 define an access opening 38 suitable for containing a watch display member.

Figure 4:
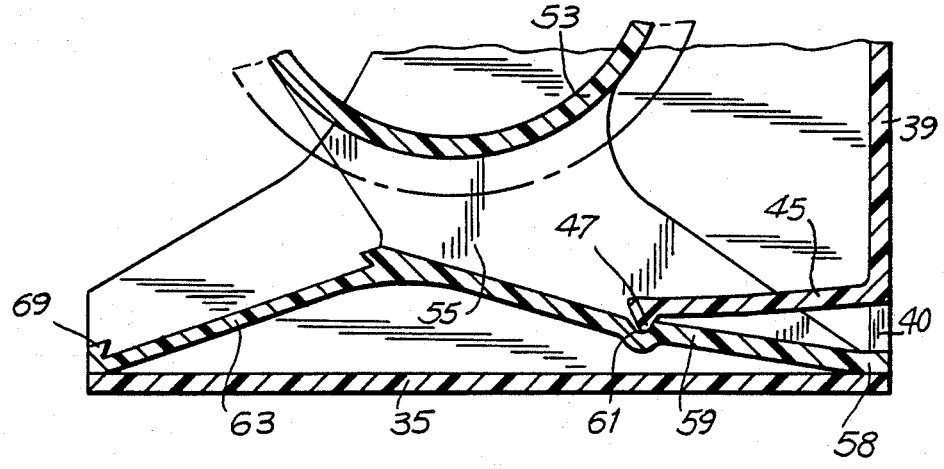
FIG. 4 is an enlarged fragmentary cross-sectional view which illustrates how the ramp of the wrist watch holder engages the tongue protruding forwardly from the rear of the wrist watch base.

Referring now to FIGS. 4 and 5, the inside of base 15 is provided with a forwardly protruding tongue 45 extending from rear wall 39 and having a downwardly extending lip or detent 47 formed at its forward end. Rear wall 39 is further formed with a laterally extending opening 40 (see FIG. 4). As described in more detail below, tongue 45 as well as opening 40 assist in removably coupling a watch holder within access opening 38 of base 15.

Side walls 37 of base 15 are provided with a pair of finger grips 43 which enable the user to grip base 15 and separate it from cover 13 when assembly 11, as shown in FIG. 1, starts out in the enclosed position.

Top wall 33 of base 15 is provided along the front edge thereof with a lateral detent 41. When cover 13 and base 15 are disposed with respect to each other in order to form an essentially closed box assembly 11, as depicted in FIG. 1, lateral detent 41 mates with groove 27 formed in bottom wall 17 of cover 13 (see FIG. 2). This helps retain cover 13 and base 15 in a substantially closed position during shipment or storage.

Figure 2:
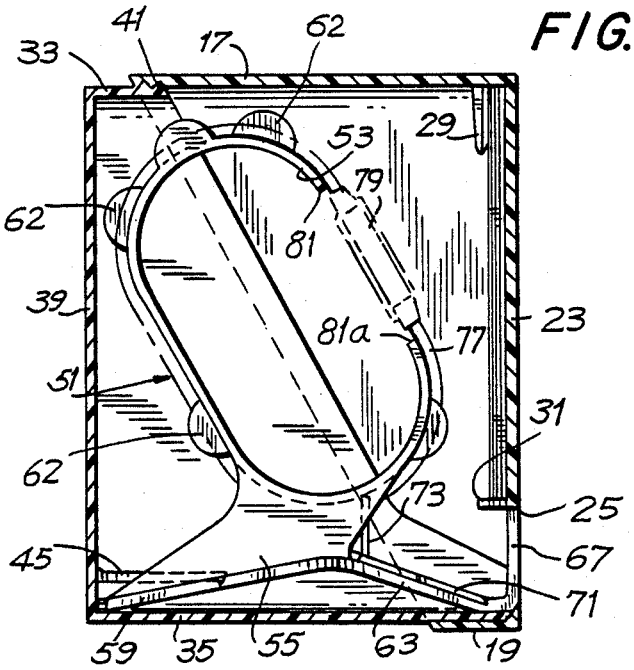
FIG. 2 is a cross-sectional view taken along line 2—2 of FIG. 1 in the direction of the arrows.
Figure 3:
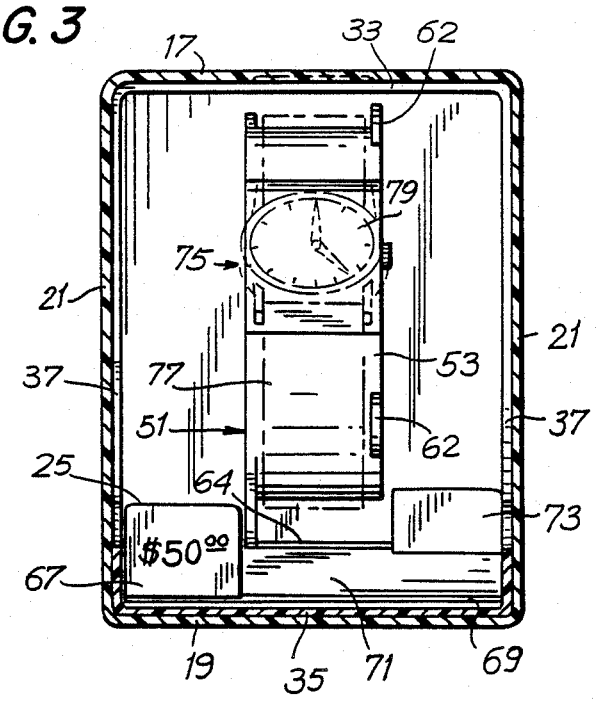
FIG. 3 is also a cross-sectional view taken along line 3—3 of FIG. 1 in the direction of the arrows.

In order for cover 13 and base 15 to nest together in the open display mode, cover 13 and base 15, as shown in FIGS. 1-3, are first separated with the aid of finger grips 43. Once separated, cover 13 is disposed beneath base 15 in the manner depicted in FIG. 6, for example by rotating it 180 degrees with respect to its horizontal axis (in a vertical plane). As a result, access opening 38 of base 15 is fully exposed for access by the user.

Turning once again to fIG. 5, as well as to FIGS. 2-4, wrist watch box assembly 11 further includes a watch holding assembly generally designated at 49. Watch holding assembly 49 comprises a collar 51 and a supporting base 57. Base 57 includes a sloped rear ramp 59 provided with a laterally extending shallow recess 61. Ramp 59 includes a tooth 58 extending from the rear end thereof.

During insertion of holding assembly 49 into base 15, as best illustrated in FIGS. 2 and 4, holding assembly 49 is received in access opening 38 of base 15 and is removably coupled to base 15 by sliding rear ramp 59 underneath tongue 45 which extends from rear wall 39 of base 15. As rear ramp 59 is slid underneath tongue 45, lip 47 begins to ride along the top surface of ramp 59 and then engages laterally extending recess 61, which releasably locks watch holding assembly 49 within access opening 38 of base 15. Simultaneously, tooth 58 of rear ramp 59 engages and is received within laterally extending opening 40 formed in rear wall 39 below tongue 45, which maintains appropriate alignment of holding assembly 49 within access opening 38 of base 15.

Significantly, tongue 45 may extend from rear wall 39 of base 15 at any angle with respect to rear ramp 59 of watch holding assembly 49 so long as lip 47 can engage recess 61 and thereby releasably lock assembly 49 in base 15. Although tongue 45 may be parallel to ramp 59, it is preferred that tongue 45 and ramp 59 form an acute angle between them when lip 47 engages recess 61 (see FIG. 4).

Base 57 of watch holding assembly 49 also includes a sloping front portion or "guide" 63, as best shown in FIGS. 4 and 5. Front portion 63 defines a support surface 65 which is suitable for slidably receiving thereon a card or tag 71. Card 71 is inserted onto surface 65 by sliding it from right to left, as shown by arrow E in FIG. 5. Card 71 is guided along surface 65 by a laterally extending front ledge 69 formed at the forward tip of slopping front portion 63 and a laterally extending rear ledge 64. Card 71 is used for advertising, display or pricing purposes and is visible to the purchaser when assembly 11 is in a display position.

Base 57 of watch holder 49 further includes a rigid tab 67 extending upwardly from the front of guide 63. Rigid tab 67 may be imprinted with various manufacturer and/or retailer trademarks or other customer information to thereby "customize" a line of watches for a particular store or retail chain. When assembly 11 is in the closed position, as illustrated in FIGS. 1 and 2, tab 67 of watch holder 49 is visible through window 25 formed in front wall 23 of cover 13. Therefore, the trademark or other information display on rigid tab 67 is visible to the buyer or customer.

Considering FIGS. 5 and 6, collar 51 of watch holder 49 includes a support member 55 mounted on base 57 and an elliptical-shaped upwardly extending loop 53 supported by member 55. Loop 53 has a first downwardly facing edge 81 and a second upwardly facing edge 81*a* and includes a series of ears 62 alternatively spaced along the opposite side edges thereof.

As is illustrated by FIGS. 2, 3, 5 and 6, a watch 75 formed with a band 77 and a case 79 of conventional construction is mounted on watch holder 49. This is achieved by encircling band 77 around the outer surface of loop 53 of collar 51 so that case 79 is disposed between edges 81 and 81*a* of loop 53. Because of the presence of ears 62, disposed along the edges of loop 53, watch 75 is prevented from sliding off collar 51.

Figure 7:
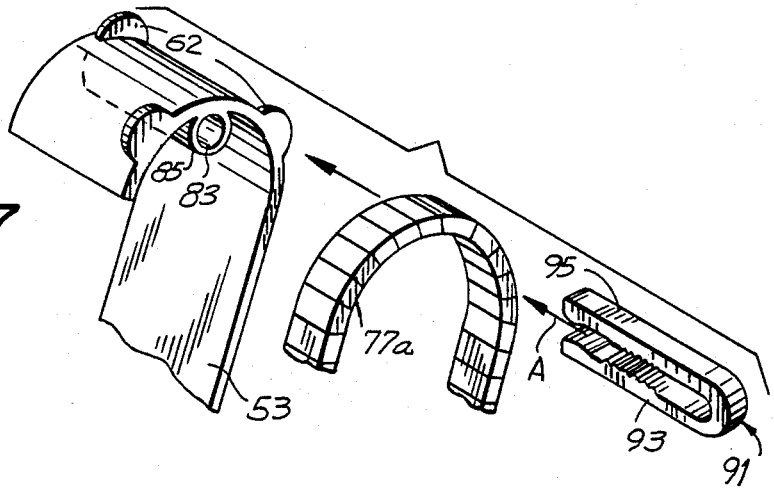
FIG. 7 is an exploded perspective view of a wrist watch band, the collar of the watch holder and a retaining clip.
Figure 8:
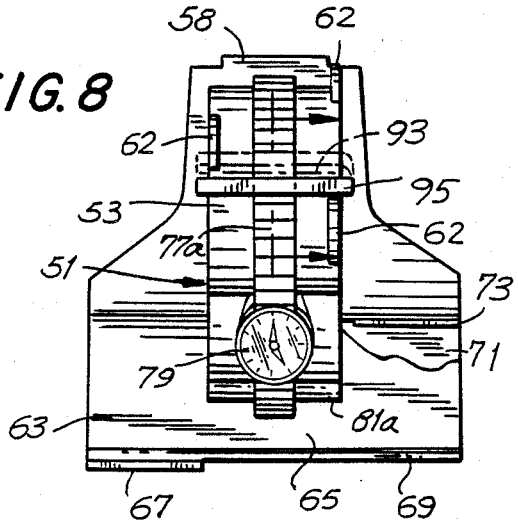
FIG. 8 is a top plan view showing the retaining clip secured over the collar of the watch holder.
Figure 9:
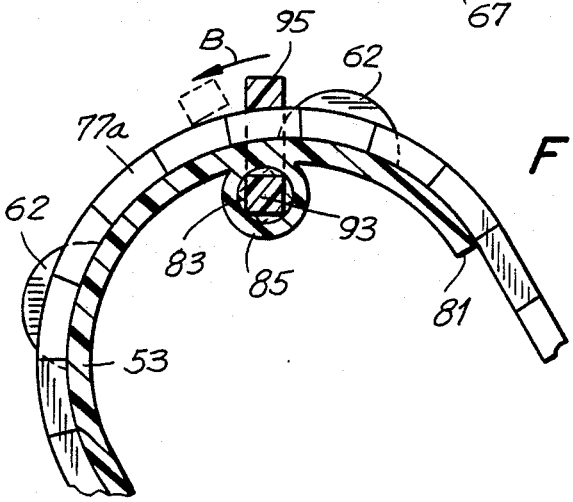
FIG. 9 is a cross-sectional view of the retaining clip shown in FIG. 8.
Figure 10:
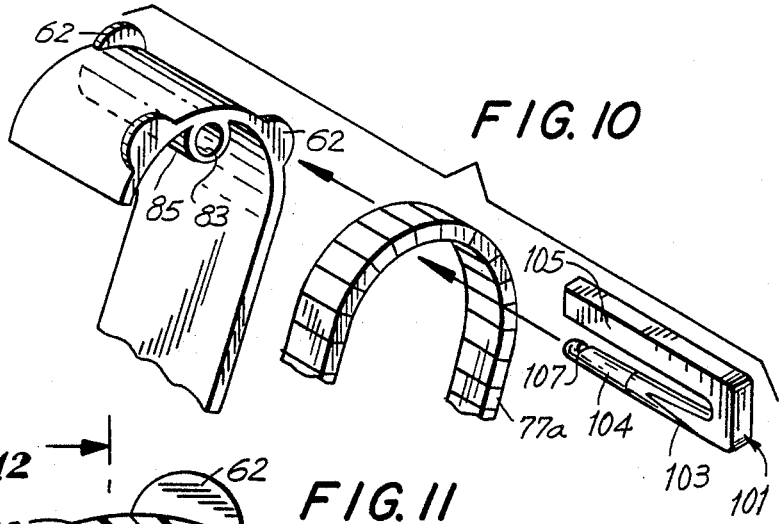
FIG. 10 is an exploded perspective view of a wrist watch band, the collar of the watch holder and a second embodiment of a retaining clip.
Figure 11:
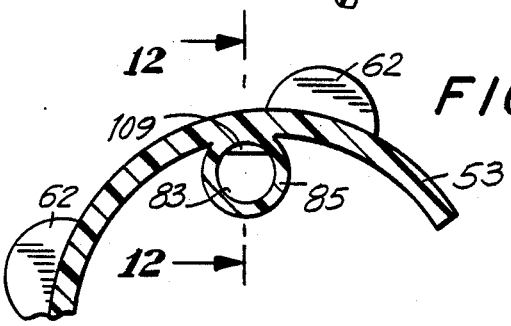
FIG. 11 is a cross-sectional view of the collar in FIG. 10, showing the inside of a tube disposed along the underside thereof.

Referring now to FIGS. 7-9, in order to help secure a watch having a relatively narrow band 77*a* (or other band of unusual configuration) to collar 51, loop 53 may be formed with an euxiliary retaining cylindrical tube 85. Tube 85 is disposed along the underside of the upper portion of loop 53 and defines a laterally extending bore 83.

As part of this optional securement mechanism, a retaining clip generally designated at 91 is provided, and includes a first lower arm 93 which may be received within bore 83, and a second upper arm 95. In order to firmly secure clip 91 so as to retain band *77a* in place, first arm 93 is inserted into bore 83 of tube 85, as is indicated by arrow A in FIG. 7. Second arm 95 is then rotated in the direction shown by arrow B in FIG. 9, which causes arm 95 to press against band *77a* and prevent it from moving or sliding along the outer surface of loop 53. In this position, arm 93 is frictionally held within bore 83 which helps maintain clip 91 pressing against band *77a*.

In a second embodiment, as illustrated in FIGS. 10–14, a second retaining clip generally designated at 101 is provided, and includes a first lower arm 103 which may be received within bore 83, and a second arm 105. Lower arm 103 includes a rounded end 104 formed with a notch 107.

Figure 12:
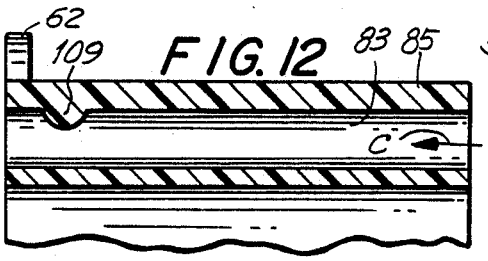
FIG. 12 is a cross-sectional view taken along line 12—12 of FIG. 11 in the direction of the arrows.
Figure 13:
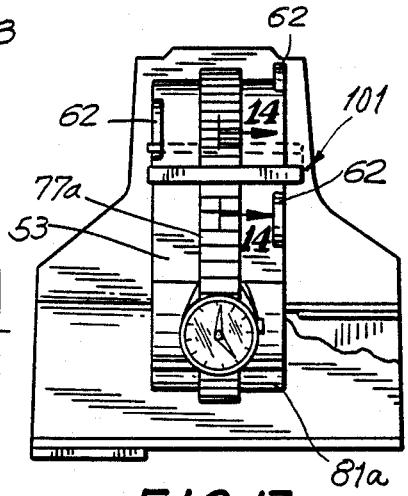
FIG. 13 is a top plan view showing the second embodiment of the retaining clip secured over the collar of the watch holder.
Figure 14:
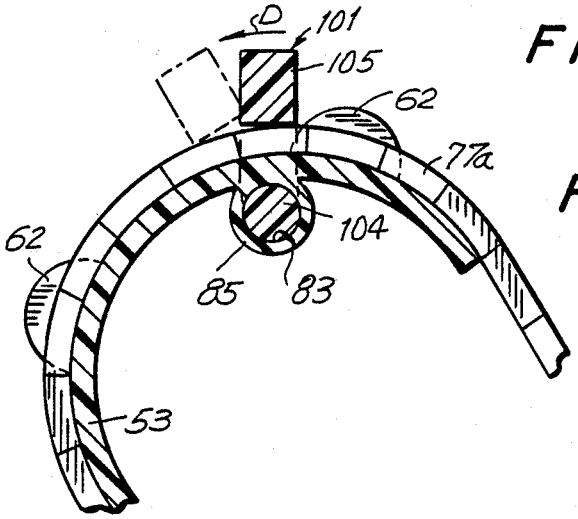
FIG. 14 is a cross-sectional view taken along line 14—14 of FIG. 13 in the direction of the arrows.

In this embodiment, as shown in FIGS. 12 and 13, tube 85 is formed with a rib 109, which extends within bore 83. In order to secure clip 101 so as to retain band *77a* in place, first arm 103 is inserted into bore 83 of tube 85, as indicated by arrow C in FIGS. 10 and 12, until rib 109 mates with or engages notch 107. Second arm 105 is then rotated in the direction shown by arrow D in FIG. 14, which causes rib 109 to press against rounded end 104 of lower arm 103, locking clip 101 against band *77a*.

In either of the emdodiments shown in FIGS. 7–9 and 10–14, the retaining clip may also be used to lock in place unusually thick bands such as chain links and bands whose length exceeds the circumference of the loop of the holding assembly.

Although this box assembly has been shown in connection with packaging and displaying a wrist watch, it is suitable in connection with all comparably configured articles for which easy display and packaging are desired.

It will thus be seen that the objects set forth above, among those made apparent from the preceding description, are efficiently attained, and since certain changes may be made in the above article without departing from the spirit and scope of the invention, it is intended that all matter contained in the above description and shown in the accompanying drawings shall be interpreted as illustrated and not in a limiting sense.

It is also to be understood that the following claims are intended to cover all of the generic and specific features of the invention herein described and all statements of the scope of the invention which, as a matter of language might be said to fall therebetween.

I claim:

1. A package for displaying or enclosing an article such as a wrist watch comprising:

a base having a front display area and a tongue fixed to said base and disposed in said display area;

a cover having an access opening and adapted to receive said base in a display position so that said display area is accessible, said cover also adapted to fit over said base in an enclosed position so that said display area is inaccessible; and a display element having an article-retaining portion and a base portion, said base portion formed with a lateral recess, wherein said tongue of said base includes a depending lip for releasably mating with said recess of said display element base portion to selectively retain said display element in said display area of said base.

2. The package of claim 1, wherein said base further includes an opening for receiving said base portion of said display element.

3. The package of claim 1, wherein said base portion of said display element comprises a front portion and a rear portion, said rear portion including said lateral recess.

4. The display element of claim 3, wherein said front portion of said display element base portion includes a support surface for slideably receiving a display card.

5. The package of claim 4, wherein said front portion includes forward and rear ledges for guiding said card.

6. The package of claim 1, wherein said article-retaining portion of said display element comprises a support member and an elliptically shaped loop supported thereon.

7. The package of claim 6, wherein said loop includes a series of ears alternatively spaced therealong.

8. The package of claim 1, wherein:

said base comprises a top wall, a bottom wall and a rear wall interconnected by a pair of opposed laterally spaced side walls; and said cover comprises a top wall, a bottom wall and a rear wall interconnected by a pair of opposed laterally spaced side walls.

9. The package of claim 8, wherein said tongue of said base extends from said base rear wall.

10. The package of claim 9, wherein said base rear wall includes an opening for receiving said base portion of said display element.

11. The package of claim 10, wherein said opening of said base rear wall is disposed below said extending tongue.

12. The package of claim 8, wherein said base further includes a detent on said base top wall, and wherein said cover includes a groove formed in said bottom wall, said groove suitable for mating with said detent when said cover and said base are in a said enclosed position.

13. The package of claim 8, wherein said cover includes means for retaining a brochure.

14. The package of claim 13, wherein said retaining means comprises at least one finger extending up from said cover bottom wall and a bar extending from said cover rear wall.

15. The package of claim 8, wherein said cover rear wall includes a window.

16. The package of claim 15, wherein said display element includes a tab visible through said window when said package is in said enclosed position.

17. The package of claim 8, wherein said laterally spaced side walls of said base include finger gripping means.

18. The package of claim 1, wherein said article-retaining portion includes means for securing said article thereto.

19. The package of claim 18, wherein said display portion includes an elliptically shaped loop on which said article is mounted, said securing means maintaining said article on said loop.

20. The package of claim 19, wherein said securing means comprises a retaining clip.

21. The package of claim 20, wherein said loop includes a bore.

22. The package of claim 21, wherein said clip includes a first arm for being inserted in said bore.

23. The package of claim 22, wherein said clip further includes a second arm for pressing against said article when said article is mounted on said loop.

24. The package of claim 22, wherein said loop further includes a rib within said bore and said first arm of said clip includes a notch for mating with said rib when said first arm is inserted in said bore.

25. A package for selectively displaying and enclosing an article such as a wrist watch comprising:

a base having a front display area;

a cover having an access opening and adapted to receive said base in a display position so that said display area is accessible, said cover also adapted to fit over said base in an enclosed position so that said display area is inaccessible;

a display element having an article-retaining portion and a base portion;

means for removably coupling said display element to said base, said coupling means disposed in said display area and riding over said base portion of said display element during the coupling of said display element to said base.

26. The package of claim 25, wherein said coupling means comprises a tongue affixed to said base.

27. The package of claim 26, wherein said base portion of said display element is formed with a lateral recess, and wherein said tongue includes depending lip, said lip releasably mating with said recess in order to selectively retain said display element in said display area of said base.

28. The package of claim 25, wherein said base includes an opening for receiving said base portion of said display element.

29. A package for selectively displaying and enclosing an article such as a wrist watch comprising:

a base having a front display area;

a cover having an access opening and adapted to receivesaid base in a display position so that said display area is accessible, said cover also adapted to fit over said base in an enclosed position so that said display area is inaccessible;

a display element having a article-retaining portion and a base portion, said base portion including a first planar element; and means for releasably coupling said display element to said base, said coupling means comprising a second planar element disposed in said display area, said first planar element being arranged non-parallel to said second planar element when said display element is coupled to said base.

30. The package of claim 29, wherein said first planar element includes a recess and said second planar element includes a lip for matingly engaging said recess when said display element is releasably coupled to said base.

31. The package of claim 29, wherein said first planar element and said second planar element form an acute angle therebetween when said display element is releasably coupled to said base.

32. The package of claim 29, wherein sid base includes an opening for receiving said first planar element when said display element is coupled to said base.

* * * * *